United States Patent [19]

Neuenschwander

[11] 3,961,397

[45] June 8, 1976

[54] CLUMP REMOVAL DEVICES

[75] Inventor: Rudolf Neuenschwander, Swarthmore, Pa.

[73] Assignee: Scott Paper Company, Philadelphia, Pa.

[22] Filed: Nov. 21, 1974

[21] Appl. No.: 525,966

[52] U.S. Cl. ..... 19/65 R; 209/3; 209/250; 19/156.3; 425/82

[51] Int. Cl.[2] ..... D01G 5/00

[58] Field of Search ..... 209/3, 250, 285; 425/80, 82, 83; 156/62.2; 19/156, 156.2, 205, 65, 156.3; 65/10

[56] References Cited

UNITED STATES PATENTS

| | | | |
|---|---|---|---|
| 754,729 | 3/1904 | White | 209/250 X |
| 2,278,092 | 3/1942 | Pearce | 65/10 |
| 2,720,005 | 10/1955 | Clark | 19/156 |
| 2,738,557 | 3/1956 | Anderson | 19/156.2 |
| 2,827,668 | 3/1958 | Clark | 19/156.2 |
| 2,838,879 | 6/1958 | Schuller | 65/10 |
| 2,919,475 | 1/1960 | Heppenstall | 19/155 |
| 2,931,076 | 4/1960 | Clark | 19/205 X |
| 3,644,078 | 2/1972 | Tachibana | 425/83 |

*Primary Examiner*—Robert Halper
*Attorney, Agent, or Firm*—M. L. Faigus; W. J. Foley

[57] ABSTRACT

Clump-removal devices are disclosed for separating unacceptably large clumps from an air stream containing both clumps and substantially individualized fibers. The devices include an inlet duct for receiving the air stream containing the fiber/clump mix; a foraminous separating surface movable past the inlet duct for intercepting the air stream to prevent clumps from passing therethrough; pressure control means for establishing a pressure drop through the separating surface to direct the air stream and the substantially individualized fibers entrained therein through the separating surface for subsequent deposition on a forming surface in the form of a fibrous web or batt; air-flow directing means spaced from the inlet duct and closely adjacent the high pressure side of the separating surface for confining the flow of inrushing air so that it is directed into engagement with the separating surface at an acute angle opposed to the direction in which the separating surface is movable, whereby the forces imposed upon the clumps by movement of the separating surface and the inrushing air agitates the clumps by causing them to vigorously roll and impact against the separating surface to aid in separating fibers which are entrained within the clumps to permit the separated fibers to pass through the separating surface and be deposited upon the forming surface; and clump-removal means for removing clumps which do not pass through the separating surface.

13 Claims, 2 Drawing Figures

CLUMP REMOVAL DEVICES

BACKGROUND OF THE INVENTION

1. Field of the Invention

This invention relates to clump-removal devices for separating clumps from an air stream which also includes substantially individualized fibers therein. More specifically, this invention relates to clump-removal devices which create a unique interaction of aerodynamic and mechanical forces upon a fiber/clump mix for aiding in separating fibers therefrom.

The term "clump", or "clumps", as used throughout this application, refers to both groups of intertangled fibers and other particulate matter which are undesirably large for inclusion in a fibrous web or batt.

2. Description of the Prior Art

Dry-formed fibrous webs or batts including a large percentage by weight of wood pulp fibers therein are well known in the prior art. These webs are formed by conveying the fibers in an air stream and depositing them in a randomly arranged and intermingled fashion on a foraminous forming surface in the form of a fibrous web or batt. For some uses, such as wipers and cover sheets for sanitary products, the strength and integrity of the web has been enhanced by including a minor proportion, i.e., up to about 25% by weight, of longer, staple-length fibers therein, and by adhesively bonding the fibers together. For other uses, such as internal absorbent components of sanitary products, unbonded fibrous batts including 100% wood pulp fibers have been satisfactorily employed.

As part of the web or batt formation process a densified pulp lap, generally in sheet form, is fed into a fiberizing device in which individual fibers are separated from the lap and directed into an air stream for deposition on a foraminous wire. One fiberizing device which is commonly employed for this purpose is the Joa Fiberizer, manufactured by Joa, Inc. of North Wales, Fl. Regardless of the fiberizing device which is employed, 100% individualization of wood pulp fibers from the lap is not achieved. Specifically, clumps of fibers may be separated from the lap as a unit, and these clumps, along with substantially individualized fibers, are directed through downstream processing equipment and are included in the completed fibrous web or batt. Moreover, other excessively large foreign particles may be included in the lap, and these particles will also be included in the completed web or batt. All of these clumps adversely affect the aesthetic properties of the web or batt, and also provide uncontrolled basis weight and physical property variations.

It is known in the prior art to employ clump-removal devices to remove clumps from an air stream containing a fiber/clump mix, and to direct substantially individualized fibers onto a foraminous forming surface to form a web or batt, as evidenced by the disclosures in U.S. Pat. Nos. 2,720,005, issued to Clark et al.; 3,575,749, issued to Kroyer; 3,581,706, issued to Rasmussen and 3,644,078, issued to Tachibana et al.

The devices disclosed in the Kroyer patent ('749) and the Rasmussen patent ('706) employ rotating impellers closely adjacent the surface of a separating screen member to agitate a fiber/clump mix thereon for the purpose of separating fibers from the clumps to permit their passage through the separating member. The Tachibana et al. patent ('078) discloses several devices which employ rotating brushes closely adjacent the surface of a separating member to agitate a fiber/clump mix for the purpose of separating substantially individualized fibers from the clumps to permit their passage through the separating member. In all of these devices a foraminous forming member is positioned in overlying relationship with the separating member, and a partial vacuum is established through the forming member to aid in directing fibers through the separating member and onto said forming member in the form of a fibrous web or batt.

The movement of a mechanical mixing device, such as an impeller or brush, in close association with a foraminous separating member can cause excessive wear of both the mechanical mixing device and the separating member. This mechanical wear can cause undesirable machine downtime for repair and/or replacement of parts. Moreover, the use of mechanical mixing devices has not been entirely satisfactory in effecting the desired vigorous agitation of a fiber/clump mix to permit efficient separation of individual fibers from the mix for passage through the separating member. In fact, the use of rotating impellers can actually cause fibers to ball up into clumps that will not pass through the separating member.

U.S. Pat. No. 2,720,005, issued to Clark et al., discloses an air scrabbler system in which jets of air are directed against the interior surface of a foraminous, stationary housing to agitate, or sift, substantially individualized fibers within the housing to permit them to pass through the housing wall and onto a foraminous forming member. This device is not intended for use in handling a fiber/clump mix. Specifically, if clumps are directed into the housing and are not broken up they will not pass through the housing wall, and eventually will block the openings in the wall to impair the operation of the device. Stating this another way, the Clark et al. device is not at all concerned with removing clumps from an air stream containing a fiber/clump mix, and in fact, the Clark et al. device will have to be stopped periodically so that clumps which remain in the inside of the housing can be manually removed. The only function that the Clark et al. device is intended to perform is to sift fibers which are already individualized so that they will pass through the stationary housing onto a forming surface.

SUMMARY OF THE INVENTION

This invention relates to clump-removal devices for separating and removing clumps from an air stream containing a fiber/clump mix. These devices create an interaction of aerodynamic and mechanical forces on the fiber/clump mix in a manner which has not been employed in prior art clump-removal devices.

Clump-removal devices of this invention include an inlet duct for receiving an air stream containing a fiber/clump mix; a foraminous separating surface which is continuously moved past the inlet duct for intercepting the air stream to prevent the clumps from passing therethrough; pressure control means for establishing a pressure drop through the separating surface to direct the air stream and fibers which pass therethrough onto a forming member in the form of a fibrous web or batt; air-flow directing means spaced from the inlet duct and closely adjacent the high pressure side of the separating surface for confining the flow of inrushing air so that it is directed into engagement with the high pressure side of the separating surface at an acute angle opposed to the direction of movement of the separating surface and clump removal means for removing clumps which do not pass through the separating surface.

The fiber/clump mix is directed into the region of the air-flow directing means by the drag imposed upon it by the moving separating surface, and in this region the clumps encounter an opposing force from the inrushing air directed past the air-flow directing means. The forces imposed upon the fiber/clump mix by movement of the separating surface and the flow of inrushing air cause the mix to roll in a vigorous, turbulent manner and also to mechanically beat against the separating member to cause fibers to separate from the fiber/-clump mix and pass through the separating surface for subsequent deposition on a forming surface. The devices of this invention also include clump-removal means for removing clumps which are not broken up by the turbulent rolling action, and for either directing them to a separate storage area, or recycling them through a fiberizer back into the inlet duct of the devices.

The devices of this invention do not require mechanical agitating means, such as impellers or rotating brushes, to perform a sifting and/or screening operation. Accordingly, the mechanical wear encountered in devices employing mechanical agitating means is not encountered in the devices of the present invention. Moreover, the agitation of the fiber/clump mix in the devices of this invention is more effective in separating fibers from the mix than the agitation effected by the use of the mechanical agitating means employed in the prior art devices. This results in a greater rate of material throughput in the devices of this invention than in equivalent sized prior art devices.

In the applicant's devices the sifting operation is achieved by the interaction of the forces imposed upon the fiber/clump mix by the movement of the foraminous separating surface and the opposing forces imposed upon the mix by the inrushing air being directed past the air-flow directing means. This unique interaction of forces is neither shown nor suggested by any of the prior art that applicant is aware of.

Other objects and advantages of this invention will become apparent upon reading the detailed description which follows taken in conjunction with the drawings.

DESCRIPTION OF THE PREFERRED EMBODIMENTS OF THE INVENTION

Figure 1:
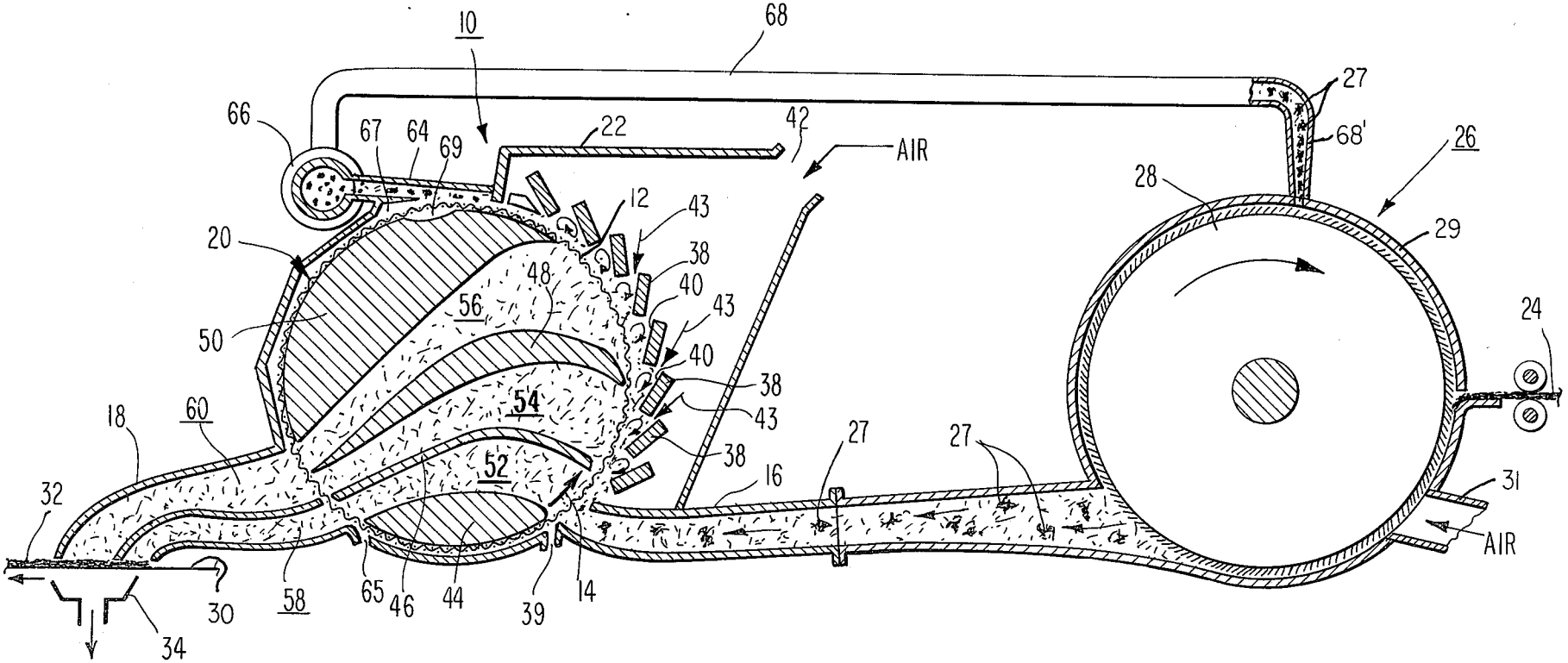
FIG. 1 is schematic sectional view showing one preferred embodiment of a clump-removal device according to this invention.

Referring to FIG. 1, a first embodiment of a clump-removal device 10 includes an endless foraminous separating surface 12 which is moved in the direction indicated by arrow 14 by any suitable drive means (not shown) to intercept both an inlet duct 16 and an outlet duct 18 of said device. In the embodiment shown in FIG. 1 the foraminous separating surface 12 is the peripheral surface of a cylindrical drum 20 which extends for substantially the full transverse extent of the clump-removal device 10 within a housing 22.

An air stream containing a fiber/clump mix is formed by directing a densified fibrous lap 24, preferably in roll form, into the in-feed section of a fiberizer 26, such as a Joa fiberizer. The fiberizer 26 includes a housing 29 in which a pin or tooth roll 28 is rotated to separate fibers from the lap 24 as the lap is directed into engagement therewith. Air is directed into the housing 29 through conduit 31 to form an air-stream of the separated fibers, and this air-stream is directed into the inlet duct 16 of the clump-removal device 10. As explained earlier in this application the fiberizer 26 also tends to separate groups of fibers from the lap, in the form of clumps 27, and these clumps also are included in the air stream which is directed into the inlet duct 16.

A web forming surface 30, in the form of a foraminous screen, is positioned adjacent the outlet duct 18 for receiving an air suspension of fibers after the clumps have been removed therefrom, whereby a substantially clump-free fibrous web or batt 32 is formed on said forming surface. A vacuum box 34 is disposed behind the forming surface 30 for establishing a pressure drop through the clump removal device 10 so that the air-suspended fibers will be directed through the device for deposition on said forming surface 30.

The cylindrical drum 20 can be formed in a well known manner to include a very open supporting shell (not shown) lined about its outer periphery with a porous screen 12. The mesh of the screen is dictated by the physical size of fibers and other particles which can be tolerated in the completed web or batt. It has been found that a screen formed from 0.015 inch diameter wire, 12 wires/inch, provides a virtually clump-free throughput of woodpulp fibers. A more open mesh screen, of approximately 8 wires/inch, will increase the fiber throughput, but the screening quality will be reduced. Therefore, the mesh of the screen employed in this invention can be varied, depending upon the fiber throughput and web quality that is desired.

A plurality of stationary, elongate bars, or vanes 38 extend for substantially the entire axial extent of the cylindrically drum 20 to form air-flow directing means. The vanes 38 are positioned closely adjacent the high pressure side of the separating surface 12, and are spaced from the inlet duct 16 in the direction of movement of said separating surface past said inlet duct. Each vane 38 has an inwardly facing surface 40 which diverges at an acute angle from the separating surface 12 in the direction of movement of said separating surface, and cooperates with the separating surface to define a compartment in which agitation of a fiber/-clump mix takes place.

The housing 22 has an opening 42 therein which can be in communication with the air in the surrounding atmosphere, or with an external air source, such as a source of humidified air. The air which communicates with the opening 42 in the housing 22 can be sucked, or drawn through the separating surface 12 by the vacuum box 34 which is disposed behind the forming screen 30. The air which enters the housing 22 through the opening 42 will be confined by the vanes 38 to flow against the high pressure side of the separating surface 12 at an acute angle, as indicated by arrows 43, opposed to the direction of movement of the separating surface 12.

A plurality of stationary flow guide ribs 44, 46, 48 and 50 are disposed within the interior of the drum 20, and define flow channels 52, 54, and 56 through the drum 20. The flow channel 52 is in communication with both the inlet duct 16 and a lower flow section 58 of the outlet duct 18. The flow channels 54 and 56 are in communication with both the air which enters opening 42 in the housing 22, and with an upper flow section 60 of the outlet duct 18. The separation of the outlet duct 18, and the interior of the rotating drum 20, as described above, is desired to maintain a separation between the hot dry air which enters the clump-removal device from the fiberizer 26 through the inlet duct 16, and the relatively higher humidity air that enters the housing 22 through the opening 42. By maintaining this separation the air entering the opening 42 is not affected by the hot dry air entering the lower passage 52 from the fiberizer 26. This arrangement permits some control over the moisture level obtained in the formed web or batt 32 to eliminate processing problems (e.g. static charge buildup) further down the production line.

The flow channels 52, 54 and 56 restrict the cross-sectional area of air-fiber flow through the drum 20 to prevent the flow from decelerating to a velocity level which will prevent the flow from passing through the separating surface 12 adjacent the outlet duct 18. If this restricted flow is not provided the velocity of the air at the downstream end of the separating drum may not be sufficient to permit the fibers to pass from within the interior of the drum for deposition on the foraminous forming surface 30. Fibers which do not pass through the drum will tend to buildup in the form of a fibrous matt on the inner surface thereof to block the openings in the drum surface and thereby impair the operation of the clump-removal device 10.

In operation a fiber/clump mix is directed from the fiberizer 26 into the inlet duct 16 into engagement with the separating surface 12, and some percentage of the fibers in the stream will be directed immediately through the separating surface 12 adjacent said inlet duct. The percentage of fibers which pass through the separating surface 12 adjacent the inlet duct 16 will depend upon the amount of free fibers present in the mix, and the speed at which the mix is directed through the inlet duct 16 to impinge upon the separating surface 12. Those fiber which pass immediately through the separating surface 12 adjacent the inlet duct 16 will pass through the flow channel 52 and out the lower flow section 58 of the outlet duct 18 for deposition on the foraminous forming surface 30.

The fiber clumps and free fibers which do not pass through the separating surface 12 adjacent the inlet duct 16 will be dragged by the separating surface 12 in the direction of its rotation, as indicated by arrow 14, past the air-flow directing vanes 38. An air seal formed by the entry of air from the atmosphere into housing 22 through opening 39 aides in preventing movement of the fiber/clump mix in the opposite direction. The pressure in the housing 22 adjacent the opening 39 is lower than the atmospheric pressure to cause the air to flow through said opening. The inwardly facing surface 40 of each vane 38 cooperates with the outer surface of the drum 20 to form a compartment in which the fibers/clump mix is exposed to inrushing air from the opening 42 in the housing 22. This inrushing air is directed by the vanes 38 in the direction of arrow 43 opposed to the movement of the separating surface 12. The cooperation of the forces imposed upon the fiber/clump mix by the inrushing air and the movement of the separating surface 12 creates fiber rollers, i.e., the fibers and clumps will be subjected to a vigorous rolling motion in a substantially circular path. These fiber rollers beat against the separating surface 12 to thereby free fibers from the mix and allow those free fibers to pass through the separating surface. As the fiber rollers grow in size they will spill over into adjacent compartments in which they are subjected to the same vigorous rolling action. Therefore, as the fiber rollers move from compartment to compartment their consistency will change from a mix containing a considerable amount of free fibers therein to a mix containing mostly clumps and only some loose fibers.

After the clumps pass the last, or most downstream vane 38, they are directed into a region adjacent a clump-removal duct, or passage 64. A partial vacuum is established through the clump-removal passage 64 by a fan 66. This partial vacuum is slightly greater than a vacuum which is established in region 67 which is disposed immediately downstream of the inlet of the clump-removal passage 64. By proper balancing the partial vacuums through the clump-removal passage 64 and the downstream area 67 in conjunction with the centrifugal force imposed upon the clumps by high speed rotation of drum 20, the clumps will leave the drum surface and become exposed to the partial vacuum established through the clump-removal passage 64. The speed of rotation of the drum 20 can be varied within wide limits, and in a preferred operation of the device it is rotated with a surface speed of from about 2,500 to about 3,000 feet per minute. Individualized fibers which are directed into the region of the clump removal passage have a lower mass than the clumps, and will tend to be dragged along the separating surface, rather than being projected off of the surface by centrifugal force. These individualized fibers will be moved along the separating surface, past the clump-removal passage and into the outlet duct 18 as a result of the partial vacuum established by vacuum box 34 disposed behind the forming surface 30. Preferably the flow guide rib 50 is recessed at 69 adjacent the clump removal passage 64 to insure that the partial vacuum established through vacuum box 34 will be effective to retain individual fibers on the separating surface 12 adjacent said clump-removal passage. Some individualized fibers may be dragged along with the clumps into the clump-removal passage 64; however, a majority of the individual fibers entering the area adjacent the clump removal passage 64 will not leave the drum surface, and will move directly to and through the outlet duct 18. An air seal is formed adjacent the outlet duct 18 by the entry of air from the atmosphere through opening 65 in the housing. This air seal will help to prevent fibers from continously moving about the drum 20, past the outlet duct 18.

The high pressure side of the fan 66 is connected through suitable duct work 68 for directing clumps from the clump-removal passage 64 into the fiberizer 26 upstream of the fiberizing area thereof. The clumps are directed into the fiberizer 26 through a flow-spreading section 68' of the duct work 68 to spread the clump flow over the entire cross-machine-direction of the fiberizer. This method of recycling the clumps permits the clumps to pass through the fiberizing area for further separation, and to be recycled into the inlet duct 16 of the clump-removal device 10 without creating an adverse effect in the cross-machine-direction basis weight of the formed web or batt 32.

Figure 2:
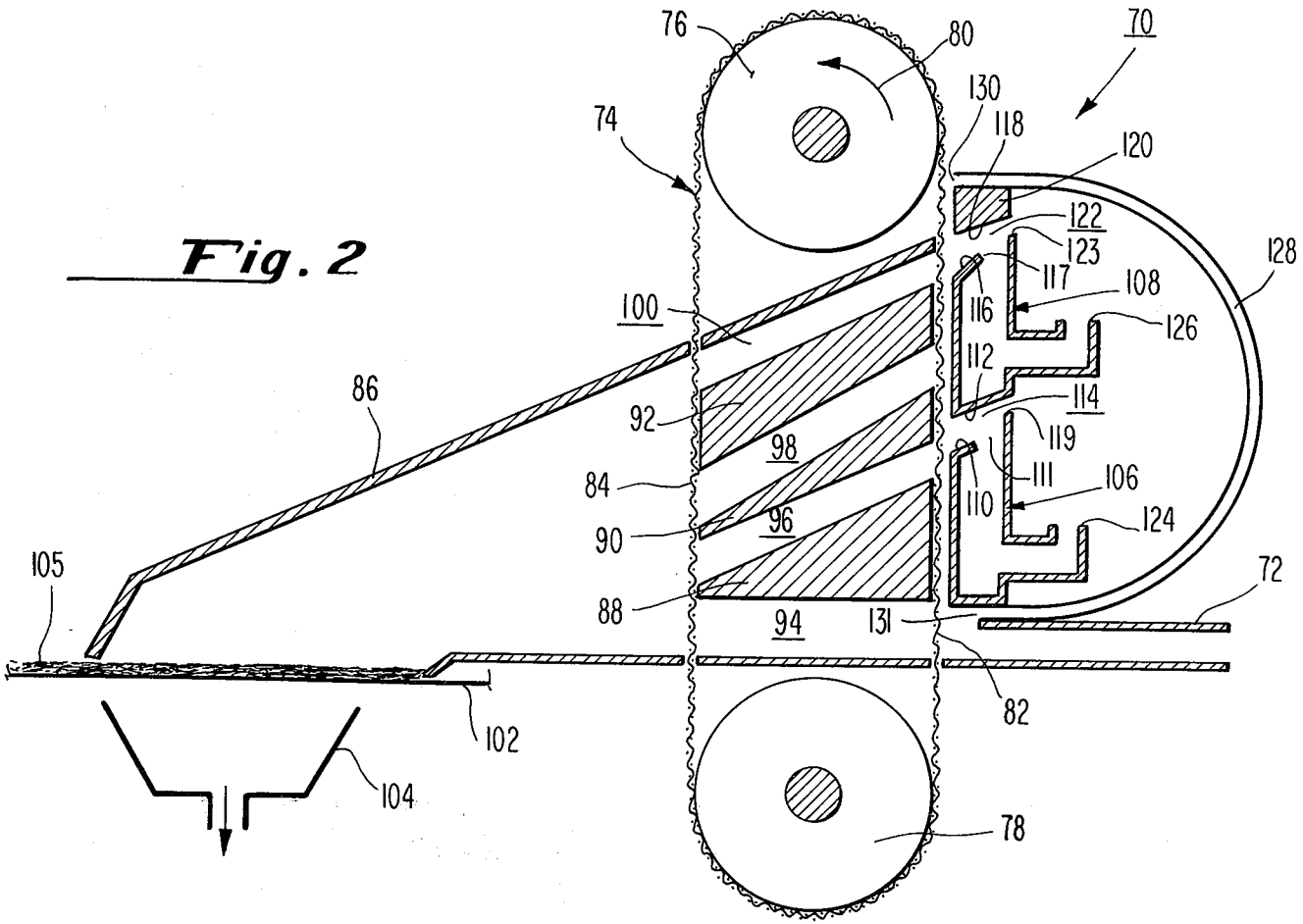
FIG. 2 is a schematic sectional view of a second embodiment of a clump-removal device according to this invention.

Referring to FIG. 2, a second embodiment of a clump-removal device 70 includes an inlet duct 72 for receiving a fiber/clump mix from a fiberizer (not shown) in the same manner as described above in connection with the clump-removal device 10 shown in FIG. 1. The clump-removal device 70 includes an endless foraminous separating surface 74 in the form of an endless foraminous screen. The separating surface 74 is trained about rolls 76 and 78, at least one of which is positively driven in the direction indicated by arrow 80. Accordingly, the separating surface 74 includes a forward run 82 which intercepts the inlet duct 72, and a rearward run 84 which intercepts an outlet duct 86.

A plurality of stationary flow guide ribs 88, 90 and 92 are disposed between the forward and rearward runs 82 and 84, respectively, of the separating surface 74 to define a plurality of flow channels 94, 96, 98 and 100 through which an air stream containing substantially individualized fibers is directed. Thes flow channels confine the flow of air-suspended fibers which pass into the interior of the endless separating surface 74 for the purpose of preventing the flow from decelerating to a level which will prevent the fibers from penetrating through the rearward run 84 of said separating surface.

A foraminous forming surface 102 closes the exit end of the outlet duct 86 and a vacuum box 104 is disposed behind said forming surface. A partial vacuum is established through the vacuum box 104 to direct the air suspension of fibers toward said forming surface. The air from the suspension passes through the forming surface 102 leaving the fibers on said surface in the form of a substantially clump-free fibrous web or batt 105.

A pair of vacuum boxes 106 and 108 are disposed in vertical alignment adjacent the high pressure side of the forward run 82 of the foraminous separating surface 74. The lower vacuum box 106 has an upper wall 110 with an inlet orifice 111 therein. The upper surface 110 cooperates with a bottom surface 112 of the upper vacuum box 108 to define an air-flow confining channel 114 for directing the flow of inrushing air at an acute angle to the forward run 82 of the foraminous separating surface 74 in a direction opposed to the direction of movement of said forward run. In a like manner, the upper vacuum box 108 includes an upper surface 116 with an inlet orifice 117 therein, and this upper surface cooperates with a downwardly facing concave surface 118 of a flow-guide block 120 to define an air-flow confining channel 122. This channel 122 also directs the flow of inrushing air against the forward run 82 of the foraminous separating surface 74 at an acute angle opposed to the direction of movement of said forward run. The entrance ends 119 and 123 of the air-flow confining channels 114 and 122, respectively, can be exposed to a source of air by either being opened to the surrounding atmosphere, or by being connected through suitable duct work (not shown) to a source of humidified air.

Each of the vacuum boxes 106 and 108 can be connected to the low pressure side of a fan (not shown) at their respective outlet orifices 124 and 126, and the high pressure side of said fans can be connected by suitable duct work to a fiberizer (not shown) in a manner similar to the connection of the clump removal duct 64 to fiberizer 26 in the clump-removal device 10.

An overflow return duct 128 has an inlet orifice 130 extending transversely across the separating member 74 at the downstream end of the forward run 82 thereof for receiving predominantly individualized fibers which do not pass through said separating member. Most of the clumps will have already been removed from the fiber/clump mix through the vacuum boxes 106 and 108 prior to the mix reaching the inlet orifice 130 of the return duct 128. Fibers entering the return duct 128 are returned through an exit orifice 131 thereof into engagement with the forward run 82 of the separating member upstream of the air-flow confining channels 114 and 122. The pressure at the exit orifice 131 of the return duct 128 is lower than the pressure adjacent inlet orifice 130 to provide the driving force required for returning the fibers back into the device 70.

In operation an air stream containing a fiber/clump mix is directed into the inlet duct 72 and directly impinges against the forward run 82 of the foraminous separating member 74. Some percentage of individual fibers will pass directly through the forward run 82 adjacent the inlet duct 72. The factors dictating the percentage of substantially individualized fibers which pass directly through the separating member in the region adjacent the inlet duct 72 have already been discussed in detail with respect to the clump-removal device 10. The fibers which pass through the forward run 82 of the separating surface 74 adjacent the inlet duct 72 will pass through flow channel 94, rearward run 84 and outlet duct 86 for deposition upon the web-forming surface 102.

Fibers and clumps which do not pass through the forward run 82 of the separating 74 are moved upwardly by the drag of the forward run 82 into the region of air-flow confining channel 114. In this region the fiber/clump mix is exposed to the force of inrushing air passing through the channel 114. This force is counter to the drag force imposed upon the fiber/clump mix by the forward run 82 of the separating surface 74. These counteracting forces create fiber rollers in substantially the same manner as in the clump-removal device 10. The fiber rollers will both roll vigorously and beat against the forward run 82 of the separating member 74 to cause fibers in the mix to separate therefrom and pass through the forward run 82 of the separating surface 74. The fiber roller will become larger in diameter as a result of the continuous feeding of fibers and fiber clumps into the region of the air-flow confining channel 114, and as these fiber rollers become larger they will be directed into the channel 114 and experience the force of the partial vacuum established through the entrance orifice 117 of the vacuum box 106. This partial vacuum will pull the clumps into the vacuum box, from where they can either be directed into a fiberizer, as described above, or into a separate storage area.

Individual fibers associated with the rollers tend to rotate in a smaller circular path, and remain closely adjacent the forward run 82 of the separating surface 74. Accordingly, a large percentage of these individual fibers will not be directed into the channel 114, and therefore, will not be picked up by the partial vacuum established through the vacuum box 106.

Part of the fiber/clump mix will be directed past the air-flow confining channel 114 by the separating member 74 and into the region associated with air-flow confining channel 122. The fibers and clumps moved into this region will experience a similar rolling and beating effect as described above in connection with the action which takes place at the air-flow confining channel 114. Also, in a like manner, clumps will be removed by the vacuum box 108 for subsequent recirculation through a fiberizer, or to a storage area.

Some of the fibers will spill over past the air-flow confining channel 122, and will be picked up in the overflow recycle duct 128 for recirculation back into the air stream in the inlet duct 72. Since most of the clumps have been removed by the vacuum boxes 106 and 108, the fibers which enter the overflow recycle duct 128 through the entrance 130 thereof are predominantly individualized, and therefore do not require recycling through the fiberizer to be broken up.

The individual fibers which pass through the forward run 82 of the separating surface 74, as a result of the creation of fiber rollers, will pass through the flow channels 96, 98 and 100, and then through the rearward run 84 of the separating surface and through the outlet duct 86 for deposition on the web-forming surface 102.

The flow channel 94 separates the hot dry air from the relatively higher humidity air passing through the air-flow confining channels 114 and 122 in a manner similar to that described above in connection with the clump-removal device 10. Although not shown in FIG. 2, the outlet duct 86 can be divided into a lower and upper section, in the same manner as described above in connection with the clump-removal device 10, for the purpose of maintaining a separation in the outlet duct between the fibers suspended in the hot dry air entering the clump-removal device from a fiberizer, and the fibers suspended in the relatively higher humidity air which enters the clump-removal device through the air-flow confining channels 114 and 122.

Having described my invention I claim:

1. A device for removing fiber clumps from an air stream containing substantially individualized fibers and fiber clumps suspended therein, said device including A. an inlet duct for receiving said air stream;

B. a foraminous separating surface movable past said inlet duct for intercepting said air stream to prevent fiber clumps from passing therethrough;

C. pressure control means for establishing a pressure drop through the separating surface to direct the air stream and substantially individualized fibers through said separating surface;

D. stationary air-flow directing means spaced from the inlet duct in the direction in which the separating surface is movable past said inlet duct, said air-flow directing means being in communication with inrushing air and being positioned closely adjacent the separating surface on the high pressure side thereof for confining the flow of said inrushing air so that it is directed into engagement with the separating surface at an acute angle opposed to the direction in which said separating surface is movable past said air-flow directing means, whereby a fiber/clump mix directed into the region of the air-flow directing means by the separating surface will be subjected to a vigorous rolling action which separates individual fibers from the fiber/clump mix for passage through the separating surface; and E. clump-removal means for removing clumps that do not pass through the separating surface.

2. The device according to claim 1, wherein said air-flow directing means define a plurality of air-flow confining paths spaced from each other in the direction in which the separating surface is movable, whereby the fiber/clump mix is subjected to a vigorous rolling action in the regions of said paths.

3. The device according to claim 2, wherein said air-flow directing means include a plurality of vanes positioned in a spaced apart relationship in the direction in which the separating surface is movable, each vane including an inner surface facing the separating surface and diverging therefrom at an acute angle in the direction in which said separating surface is movable for cooperating with said separating surface to define a compartment in which the vigorous rolling action of the fiber/clump mix takes place.

4. The device according to claim 1, wherein said clump-removal means includes a clump-removal passage and pressure control means for establishing a pressure drop through said passage for removing fiber clumps therethrough.

5. The device according to claim 4, wherein said pressure control means is in communication with recycle duct work, said recycle duct work communicating with a fiberizer in which the air-stream of fibers and fiber clumps is formed for passage into the inlet duct, whereby fiber clumps removed from the device through the clump-removal passage are directed through the recycle duct work into the fiberizer for fiberization and passage into the device through the inlet duct.

6. A device according to claim 1, wherein said separating surface is an endless member which is also movable past an outlet duct, whereby fibers passing through the separating surface adjacent the inlet duct pass through the interior of the endless member and exit through the separating surface adjacent the outlet duct.

7. The device according to claim 6, including stationary flow guide ribs disposed within said endless member for defining flow channels in communication with the outlet duct to direct the flow of air suspended fibers, which is substantially free of clumps, to said outlet duct from the interior of said endless member.

8. The device according to claim 6, wherein said endless member is a cylindrical drum.

9. The device according to claim 6, wherein said endless member is a screen disposed about spaced rolls to define a forward run which intercepts the inlet duct and a rearward run which intercepts the outlet duct.

10. The device according to claim 9, including a return duct having an inlet orifice communicating with the forward run of the screen downstream of the air-flow directing means, and an outlet orifice communicating with the forward run of the screen upstream of the air-flow directing means, the pressure adjacent said outlet orifice being lower than the pressure adjacent said inlet orifice, whereby substantially individualized fibers which are moved past the air-flow directing means without passing through the screen are directed into the inlet orifice of the return duct and returned through the outlet orifice thereof adjacent the forward run of the separating screen upstream of the air-flow directing means.

11. A device according to claim 9, wherein said air-flow directing means is adjacent the forward run of the screen and includes opposing surfaces defining a channel for confining the flow of the inrushing air, one of said surfaces including an orifice therethrough, and a vacuum creating means for establishing a partial vacuum through said orifice for removing fiber clumps therethrough.

12. The device according to claim 11, wherein said air-flow directing means includes at least a pair of channels for confining the flow of the inrushing air, each of said channels being defined by opposing surfaces, one of the surfaces defining each channel including an orifice therethrough, and vacuum creating means associated with each of said orifices for establishing a partial vacuum through said orifices for removing fiber clumps therethrough.

13. The device according to claim 11, including recycle duct work in communication with both the high pressure side of the vacuum creating means and a fiberizer in which the air stream of fibers and fiber clumps is initially formed for passage into the inlet duct of the device, whereby fiber clumps directed through the orifice in the channel-defining surface is directed into the fiberizer for fiberization and passage into the device through said inlet duct.

* * * * *